United States Patent [19]

McManaway

[11] 4,083,466

[45] Apr. 11, 1978

[54] PAINT CONTAINER EXTENSION FOR SUPPORTING A PAINT ROLLER DISTRIBUTOR

[76] Inventor: C. Chalmer McManaway, 433 Barnett St., West Palm Beach, Fla. 33405

[21] Appl. No.: 799,724

[22] Filed: May 23, 1977

[51] Int. Cl.[2] ..... B65D 25/00; B65D 7/00

[52] U.S. Cl. ..... 220/90; 220/4 A; 222/569; 222/570

[58] Field of Search ..... 220/90, 4 A; 222/569, 222/570

[56] References Cited

U.S. PATENT DOCUMENTS

| | | | |
|---|---|---|---|
| 1,698,403 | 1/1929 | Harris | 220/90 X |
| 2,688,418 | 9/1954 | Carter | 220/90 X |
| 2,705,334 | 4/1955 | Farrow | 220/90 X |
| 3,309,000 | 3/1967 | Haverstick | 220/90 X |
| 4,022,344 | 5/1977 | Roamer | 220/90 X |

*Primary Examiner*—William Price
*Assistant Examiner*—Steven M. Pollard
*Attorney, Agent, or Firm*—Jack N. McCarthy

[57] ABSTRACT

A paint container extension is fixed to the top of a paint container for supporting a paint roller distributor or a wiping and saturating device to properly distribute paint on a roller surface. The paint container extension has a center line extending at an angle from the top of said paint container and has the plane of the top of the extension normal to the center line of the extension. The paint distributor is formed having substantially parallel sides with hooks at the top for hanging on the top of the paint container extension. The distributor is hooked over the extension where the center of the distributor is closest to the lowest point around the top of the extension. At this point, the distributor extends into the paint container at approximately the same angle as the extension. The distributor extends into the paint container to a point short of the center line of the paint container. This permits the roller to extend into the paint and make a complete revolution along the free surface of the distributor above the surface of the paint in the container when it is at least half-filled. The paint container extension has a handle and flange means at its top for receiving the paint container cover.

12 Claims, 5 Drawing Figures

PAINT CONTAINER EXTENSION FOR SUPPORTING A PAINT ROLLER DISTRIBUTOR

BACKGROUND OF THE INVENTION

This invention relates to paint container extensions for use with paint rollers and paint roller distributors, especially for commercial use and use with large containers; for example, five-gallon containers.

Previously, paint container extensions have been used merely to provide an extension for the paint container so that a solvent, pigment, or other liquid, could be added to the paint without changing it into a larger container for mixing and blending. Paint container extensions were also used to merely facilitate the pouring of the material from the paint container to prevent spilling during the pouring process. Patents setting forth these functions are the following: U.S. Pat. No. 1,698,403; U.S. Pat. No. 1,865,736; U.S. Pat. No. 2,688,418; and U.S. Pat. No. 3,309,000.

Further, paint roller distributors, or roller wiping devices, were merely hung or connected to the paint container itself, without regard for the amount of paint in the container compared with the free wiping surface of the paint roller distributor, or wiping device. Patents setting forth these functions are: U.S. Pat. No. 2,705,334; U.S. Pat. No. 2,893,030 and U.S. Pat. No. 3,394,425.

SUMMARY OF THE INVENTION

A primary object of this invention is to provide a paint container extension for supporting a paint roller distributor so that the paint roller distributor will be properly placed considering the amount of paint in the container compared with the free wiping surface of the paint roller distributor.

In accordance with the present invention, the paint container extension is fixed to the top of the paint container by a circular clamping device so that the handle on the extension will lift both the paint container extension and the paint container.

In accordance with a further aspect of the present invention, the top of the paint container extension is formed in a manner similar to the top of the paint container so that the cover removed from the paint container can be placed on the top of the paint container extension.

In accordance with another aspect of the present invention, the paint container extension has a center line which extends at an angle from the flat plane of the top of the paint container. This angle provides for easy insertion and proper removal of a paint roller when used by a painter.

DESCRIPTION OF THE PREFERRED EMBODIMENT

Figure 1:
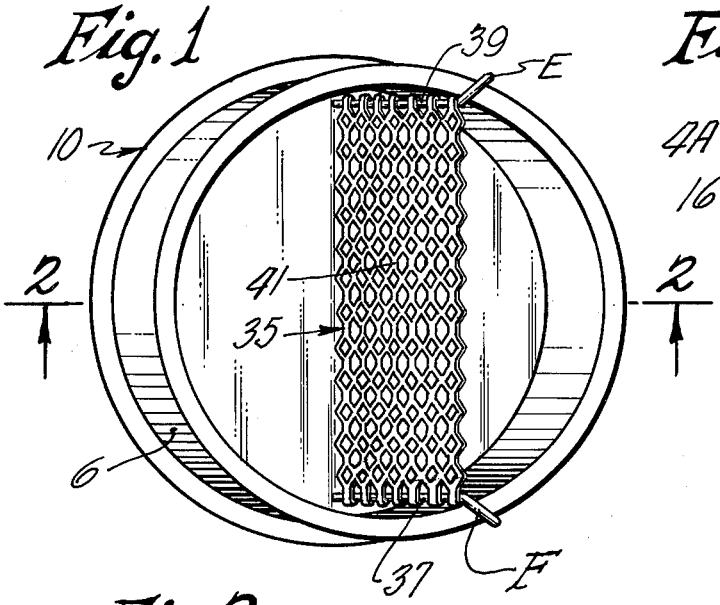
FIG. 1 is a top view of the paint container and paint container extension with a paint roller distributor in place.
Figure 3:
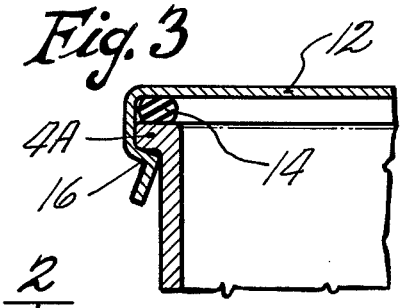
FIG. 3 is a view of the paint container cover positioned on top of a paint container extension. (This Figure would be identical for the cover on top of the paint container).
Figure 2:
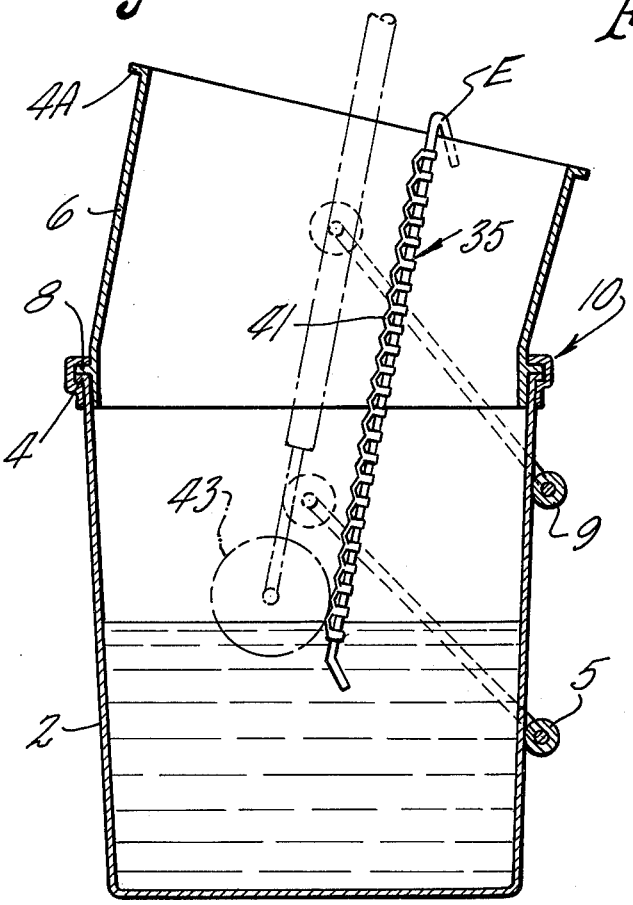
FIG. 2 is a view taken along the line 2—2 of FIG. 1 showing the angle of the paint container extension and paint roller distributor with a paint roller shown in phantom.

Referring to the drawings, FIG. 2 shows a paint container 2 having an outwardly extending flange 4 around the top thereof and a conventional handle 5 pivoted thereto at diametrically opposed locations. A tubular paint container extension 6 is shown on the top of the paint container 2 with a flange 8 which extends around the extension 6 adjacent the bottom thereof, placed against flange 4 of the paint container. The paint container extension 6 also has a similar handle 9. A circular clamping device 10 extends around the circular flanges 4 and 8 and clamps them together as one unit. If desired for sealing, an O-ring or gasket could be placed between the two flanges. The bottom portion of the extension extends into the top of the paint container 2 for guiding it, and to prevent leakage when in use, and the top portion extends outwardly with its center line at an angle of approximately 15° to the center line of the paint container 2 for a purpose to be hereinafter described. A flange 4A extends around the top of the paint container extension 6 which is formed of the same size as flange 4. This is done so that the same cover 12 of the paint container can also be used on the paint container extension. A sealing ring 14 is located in the cover 12 to provide a seal when the necked down portion 16 of the cover 12 is forced over the circular flange 4A or 4.

Figure 4:
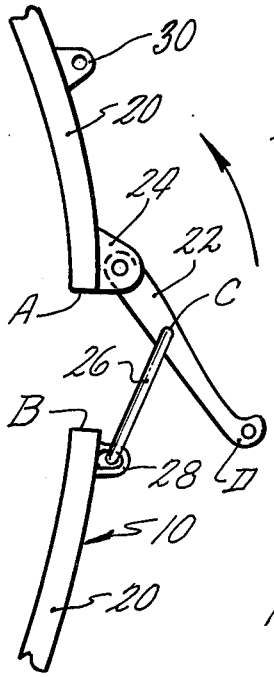
FIG. 4 is a top fragmentary view of the actuation lever and connecting link of the circular clamping device when fixing the paint container extension on the paint container.
Figure 5:
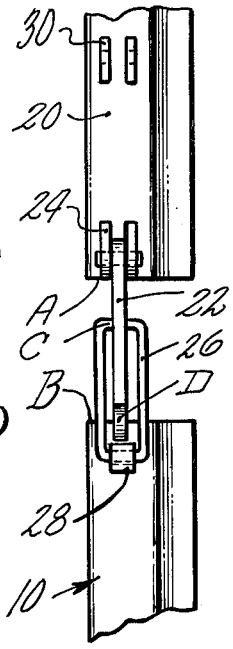
FIG. 5 is a view of the circular clamping device taken from the right of FIG. 4.

The circular clamping device 10 comprises a circular-like band 20 which is interrupted along its length to provide two ends A and B for movement away from each other or towards each other for opening and closing of the band. The circular clamping device 10 has an actuation lever 22 pivotally mounted to a bracket 24 fixed to the outer periphery of the circular-like band 20 at A. A connecting link 26 is pivotally mounted at one end to a boss 28 fixed to the outer periphery of the circular-like band 20 at B. The other end of the connecting link 26 is pivotally mounted to a point C along the length of actuation lever 22. The actuation lever 22 and the connecting link 26 are so positioned that when the actuation lever 22 is placed in a position where the free end D engages a boss 30 on the outer periphery of the band 20, the ends A and B are drawn towards each other to a point where the clamping device 10 will hold the flanges 4 and 8 tightly together. Small openings are provided in the end D of the actuation lever 22 and boss 30 to place a locking pin means therethrough to prevent accidental disengagement of the circular clamping device 10, thereby releasing the paint container extension 6. It can be seen from FIGS. 4 and 5 that the ends A and B are spaced far enough apart so that the circular clamping device 10 would permit the flanges 4 and 8 to be separated from each other for removal of the paint container extension 6. While one specific clamping device has been shown, any clamping means desired can be used.

A paint roller distributor 35, such as shown in U.S. Pat. No. 3,394,425, is shown having side rods 37 and 39, which are substantially parallel to each other with a frictional perforate surface 41 therebetween so that paint can be distributed on a roller by rolling it across the surface from adjacent the bottom to the top thereof. The tops of the rods 37 and 39 are bent at E and F to hook over the top of the paint container extension 6. In its position in FIG. 2, the sides of the paint roller distributor 35 along the rods 37 and 39 engage the sides of the paint container extension 6 and permit it to extend into the paint container 2 approximately at the angle of the center line of the paint container extension 6.

The paint container extension 6 is sized and the length of the paint roller distributor 35 is such that the paint in the container can be at least to the halfway mark of the paint container 2, yet allow for submersion of the roller 43 in the paint and allow a full rotation of the roller 43 against the exposed portion of the frictional perforate surface 41 as the roller is being drawn out of the paint container 2 and extension 6 for applying the paint to a surface. When the word "paint" is used, it is meant to cover liquids which can be rolled on to a surface.

In a test made, a five-gallon plastic paint container was used, an extension was made approximately 7 inches (17.78 cm.) along the center line, and fixed to the top of the container with the center line approximately 15° to the center line of the container, a distributor was made having a 14-inch (35.56 cm.) wiping surface and a 9½-inch (24.13 cm.) width, and a paint roller having a 9-inch (22.86 cm.) width and approximately a 3-inch (7.62 cm.) diameter roller was used. This combination provided a time saving over the use of a regular five-gallon container with conventional paint rolling devices. The five-gallon container used in the test was approximately 14¼inches (36.20 cm.) high and tapered slightly from approximately an 11¼-inch (28.58 cm.) diameter circular top to approximately a 10¼-inch (26.04 cm.) diameter circular bottom.

I claim:

1. A paint container extension for supporting a paint roller distributor for paint rolling adapted to be mounted on an annular rim of a paint container, said paint container extension comprising a tubular member having a center line for extending at an angle to the center line of a paint container, said tubular member having a top rim, said tubular member when mounted on an annular rim of a paint container extending in an angular direction away therefrom for extending over the side of a paint container with one part of its top rim extending the furthest from the center line of a paint container, the bottom of said tubular member having flange means for engaging the annular rim of a paint container, each side of the part of the top rim of the tubular member extending the furthest from the center line of a paint container providing a top support for a paint roller distributor so that the paint roller distributor will extend into a paint container at an angle thereto.

2. A combination as set forth in claim 1 wherein a paint roller distributor will extend into a paint container at an angle approximately that which the center line of the tubular member makes with the center line of the paint container, each inner side of said tubular member of the paint container extension on either side of the part of the top rim extending the furthest from the center line of a paint container providing a side support for each side of a paint roller distributor.

3. A combination as set forth in claim 1 wherein said tubular member has approximately the same diametrical size as the paint container, said flange means of the bottom of said tubular member being adapted for clamping it on the annular rim of a paint container connecting the tubular member to a paint container as a unit.

4. A combination as set forth in claim 3 including a circular clamp means for clamping the flange means of the bottom of said tubular member to the annular rim of a paint container.

5. A combination as set forth in claim 4 wherein said tubular member has a handle for lifting said paint container extension and a paint container when they are clamped together as one unit.

6. A combination as set forth in claim 1 wherein the plane of the top rim of said tubular member has a low part, the low part along the top rim of said tubular member being located at the part of the top rim of said tubular member extending the furthest from the center line of a paint container.

7. A combination as set forth in claim 1 wherein the low part of the top rim is located a predetermined distance above the top of a paint container so that a paint roller distributor supported by the top rim of the tubular member will extend into a paint container to a point short of the center line of the paint container.

8. In combination a paint container, a paint container extension for paint rolling for supporting a paint roller distributor, said paint container extension being adapted to be mounted on the top of said paint container, said extension comprising a tubular member with its center line extending at an angle to the center line of the paint container, said tubular member having a top rim, said tubular member extending in an angular direction over the side of the paint container with one part of its top rim extending the furthest from the center line of the paint container, the bottom of said tubular member having first flange means, said paint container having second flange means around the top thereof, circular clamping means fixing said first and second flange means together, each side of the part of the top rim of the tubular member extending the furthest from the center line of the paint container providing a top support for a paint roller distributor so that the paint roller distributor will extend into the paint container at an angle thereto, each inner side of said tubular member of the paint container extension on either side of the part of the top rim extending the furthest from the center line of the paint container providing a side support for each side of a paint roller distributor.

9. A combination as set forth in claim 8 wherein the plane of the top rim of said tubular member provides a low part, the low part of the top rim of the tubular member being located at the part of the top rim of said tubular member extending the furthest from the center line of the paint container.

10. A combination as set forth in claim 8 wherein said first flange means is an outwardly extending annular flange said second flange means is an outwardly extending annular flange, both of said outwardly extending annular flanges engaging each other and with their outer ends having the same outer diameter, said clamping means engaging both of said outwardly extending annular flanges around their outer ends.

11. A combination as set forth in claim 8 including a paint roller distributor, said distributor comprising substantially parallel sides with means on the top thereof to be connected to the top rim of the tubular member, said distributor having hook means on the top of either side thereof, each hook means being placed over the top of the rim of said tubular member on each side of the part of the top rim of the tubular member extending the furthest from the center line of the paint container, each side of said distributor contacting a side of the tubular member along its length for supporting said sides of said distributor.

12. A combination as set forth in claim 11 wherein said paint roller distributor extends into said paint container to a point short of the center line of the paint container.

* * * * *